United States Patent [19]

Levy

[11] 3,989,279

[45] Nov. 2, 1976

[54] LATENT INDICIA CARRIER

[76] Inventor: Leon M. Levy, 2047 Dayton St., Chicago, Ill. 60614

[22] Filed: June 4, 1975

[21] Appl. No.: 583,544

[52] U.S. Cl. ..... 283/8 B; 426/77; 426/87

[51] Int. Cl.[2] ..... B42D 15/00

[58] Field of Search ..... 283/6–8, 283/23; 206/.5; 229/53, 83; 426/77, 82, 83, 87, 88, 383; 35/9 G

[56] References Cited

UNITED STATES PATENTS

| | | | |
|---|---|---|---|
| 2,622,471 | 12/1952 | Sparks | 283/6 X |
| 3,363,336 | 1/1968 | Skinner | 35/9 G X |
| 3,823,022 | 7/1974 | Thomas | 35/9 G X |

*Primary Examiner*—Lawrence Charles
*Attorney, Agent, or Firm*—Max R. Kraus

[57] ABSTRACT

A package such as a tea bag has a side surface thereof on which is printed a message. The message is printed with materials that are substantially indistinguishable with the naked eye until a staining agent is activated which selectively stains the package surface but not the indicia thereon to produce a visibly apparent display.

3 Claims, 2 Drawing Figures

LATENT INDICIA CARRIER

BACKGROUND OF THE INVENTION

Hidden indicia have been used in the past in conjunction with photographic processes and the like in which developers are used to expose or develop the indicia thereby providing a message which appears on a carrier. In the use of many prior art systems, expensive or caustic developers must be used in order to develop the hidden indicia into a readily visible display. This is often undesirable, particularly where the indicia is to be used in conjunction with small children or in a mass producing system in which an inexpensive developer is required or with food where toxicity must be avoided. Expensive and dangerous systems are avoided by the present invention which utilizes water as an activator.

SUMMARY OF THE INVENTION

An important object of the present invention is to provide means by which hidden indicia becomes visible with the application of water thereto.

Another object of the present invention is to provide a carrier, latent indicia on the carrier, and means associated with the carrier for selectively staining one of the carrier and the indicia to provide contrast between the indicia and the carrier to make the indicia visible.

Still another object of the present invention is to provide a tea bag, latent indicia on at least one side of the tea bag, and tea in the tea bag which upon contact with water selectively stains the tea bag to provide contrast between the indicia and the stained tea bag to make the indicia visible.

These and other objects of the present invention may be more readily understood when taken in conjunction with the following drawings, in which:

DESCRIPTION OF THE PREFERRED EMBODIMENT

Figure 1:
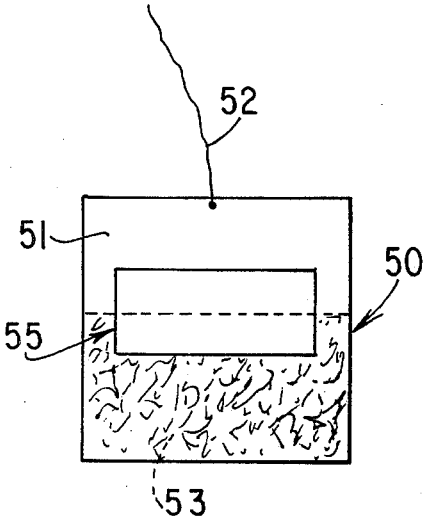
FIG. 1 is a side elevational view of a tea bag having an area for hidden indicia thereof.
Figure 2:
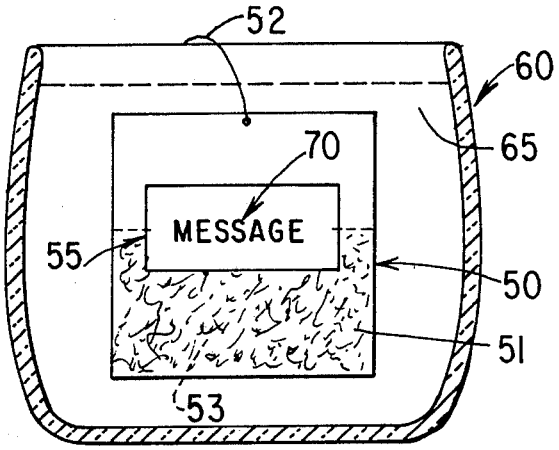
FIG. 2 is a sectional view of a container having hot water therein which causes the tea in the tea bag selectively to stain the tea bag to provide contrast between the latent indicia and the tea bag causing the indicia to become visible.

Referring now to the drawings, and in particular to FIG. 1 thereof, there is shown a tea bag 50 including a pouch 51, the usual string 52, the pouch forming a container for tea 53. The tea bag 50 has a side surface with an area 55 on which is provided a latent indicia which in the dry state as illustrated in FIG. 1, is substantially non-detectable by the eye. The indicia 70 which is seen in FIG. 2, may be printed on the side of the pouch 51 with a wax based marking pencil or suitable non-toxic ink. When the tea bag 50 is introduced into hot boiling water 65 (see FIG. 2), the tea 53 in the bag 50 colors the water 65 in a well known manner and also stains the tea bag 50 and more particularly the side of the pouch 51. When the sides 51 of the tea bag 50 becomes stained, the indicia 70 become visible to convey a message.

The principal characteristics of the indicia 70 are that the indicia 70 be substantially invisible when the tea bag 50 is dry. The indicia 70 may be substantially the same color as the color as the tea bag 50, whereby the indicia will not be readily visible to the naked eye or the indicia may be substantially transparent, whereby the indicia will not be readily visible to the naked eye. In any event, the indicia 70 must have different staining or non-staining properties than the surface 51 on which it is placed. For instance, if the tea bag 50, which may be a non-woven cellulosic material, accepts brown stains from the wet tea 53, then the indicia 70 should either accept no stain or stain a different color or shade than brown. A wax-based marking pencil will provide a latent indicia 70 which becomes white against a brown background after the tea bag 50 has been introduced into hot boiling water 65.

The material which is used to print the latent indicia 70 on the tea bag should be non-toxic and preferably non-soluble.

Use of the present invention in tea bags is convenient because the tea bag provides the staining agent or tea in the construction so that introduction of the tea bag into boiling water will provide stain with which to discolor the carrier or tea bag with respect to the indicia which does not discolor. Clearly, however, the construction can be arranged in which the staining compound would not be accepted by the carrier but by the latent indicia, whereby the latent indicia would then take on a stained color different than the carrier and again would become visible. It is also apparent that the carrier can be comprised of a variety of materials in addition to the non-woven cellulosic material used in tea bags. For instance, cloth could be used as well as certain synthetic organic resins.

While there has been described herein what is at present to be considered the preferred embodiment of the present invention, it will be understood that various modifications and alterations may be made therein without departing from the true scope of the present invention, and it is intended to cover all such alterations and modifications in the appended claims.

What is claimed is:

1. A receptacle formed of a non-woven cellulosic material, indicia impressed on one exposed surface of said receptacle which is normally substantially indistinguishable, tea inside the receptacle which upon contact with water stains the receptacle but not the indicia to provide contrast between said indicia and the receptacle to make said indicia visible.

2. The combination set forth in claim 1, wherein said indicia is formed from a wax based compound.

3. The combination set forth in claim 1, wherein said indicia is comprised of a non-toxic water insoluble material.

* * * * *